US006374543B1

(12) United States Patent
Bishai

(10) Patent No.: US 6,374,543 B1
(45) Date of Patent: Apr. 23, 2002

(54) DOOR OPENER APPARATUS WITH POWER TRANSFER MECHANISM

(76) Inventor: Magdy N. Bishai, 3566 E. Hiawatha Dr., Okemos, MI (US) 48864-4041

( * ) Notice: Subject to any disclaimer, the term of this patent is extended or adjusted under 35 U.S.C. 154(b) by 0 days.

(21) Appl. No.: 09/588,260

(22) Filed: Jun. 6, 2000

(51) Int. Cl.[7] ..... E05F 11/00
(52) U.S. Cl. ..... 49/199; 49/197
(58) Field of Search ..... 49/197, 199, 200, 49/339, 340, 341; 160/188, 189, 201

(56) References Cited

U.S. PATENT DOCUMENTS 2,026,956 A * 1/1936 Allen ..... 49/199
2,560,236 A * 7/1951 McNinch et al. ..... 49/199
2,687,298 A * 8/1954 Maple
3,270,572 A * 9/1966 Zimmerle et al.
3,471,971 A * 10/1969 Richmond
3,955,661 A * 5/1976 Popper et al. ..... 192/150
4,794,731 A * 1/1989 Willmott et al. ..... 49/199
5,221,869 A 6/1993 Williams et al.
5,222,327 A * 6/1993 Fellows et al. ..... 49/139
5,841,253 A 11/1998 Fitzgibbon et al.
5,918,418 A 7/1999 Richmond et al.
5,927,690 A 7/1999 White et al.
5,931,212 A 8/1999 Mullet et al.

* cited by examiner

*Primary Examiner*—Curtis A. Cohen
(74) *Attorney, Agent, or Firm*—Ian C. McLeod

(57) ABSTRACT

A garage door opener apparatus (10) with a transfer mechanism (50) is described. The transfer mechanism includes motor sprocket (59), chain (52, 52A), drive sprocket (53, 53A), shaft (54, 54A), driven sprocket (64, 64A) and chain (65, 65A) connected to a carriage assembly (20). The transfer mechanism enables positioning of the apparatus in a building (100) with an obstruction such as a beam (102) and safely allows transfer of the rotation of the motor sprocket to the door (101).

23 Claims, 5 Drawing Sheets

10
D 102
50
34
54
55
53
56
40
64
35
42
41
52
63
202
44
51
59
43
65
100
30
31
103
200
402
23
66
401
22
20
33
200
300
105
403
400
67
104
32
201
21
201
101
201
201
201

DOOR OPENER APPARATUS WITH POWER TRANSFER MECHANISM

CROSS-REFERENCE TO RELATED APPLICATIONS

This application is based upon provisional U.S. Application Serial No. 09/480,239, filed Jan. 10, 2000.

BACKGROUND OF THE INVENTION (1) Field of the Invention

The present invention relates to an improved reversibly operating door opener apparatus with a power transfer mechanism between a drive motor and a first flexible drive means and a second flexible drive means operating a carriage assembly for the door. In particular, the present invention relates to a relatively compact door opener which enables mounting in a relatively small space in a building; particularly, a garage.

(2) Description of the Related Art

U.S. Pat. No. 4,794,731 to Willmott et al; U.S. Pat. No. 5,221,869 to Williams et al; U.S. Pat. No. 5,918,418 to Richmond et al; U.S. Pat. No. 51927,690 to White et al and U.S. Pat. No. 5,931,212 to Mullet et al describe various types of door opener mechanisms. In each of these patents, the motor assembly directly transfers the power to a flexible drive member attached to a carriage assembly mounted on the door. As a result, the door opener apparatus will not fit into a relatively small space which is confined by a barrier, beam or other obstruction in the building. There is a need for an improved door opener apparatus which enables mounting in such a confined space. Only of general interest is U.S. Pat. No. 5,841,253 to Fitzgibbon et al.

Up until about 1992, cables on the side of the door could be operated by a pulley and motor mounted on a door frame. This construction is no longer regarded as being safe and is not approved by the Federal Government. Such an apparatus, if legal, would enable door openings even in the presence of a barrier in the building. There has been no replacement for this type of apparatus.

Thus, there is a need for a door opener apparatus which operates in a confined space and which is safe.

SUMMARY OF THE INVENTION

The present invention relates to a door operating apparatus for a reversibly operable door in a building, which comprises: a frame with opposed ends to be mounted and extend away from the door inside the building; a carriage assembly mounted on the frame at one of the ends so as to be adjacent to and connected to the door and linearly moveable on the frame for moving the door between open and closed positions; a first flexible drive means connected to the carriage assembly and which extends adjacent the frame away from the one of the ends of the frame and which when activated moves the carriage to open and close the door; a rotatable driven member mounted on the frame, which driven member mounts and drives the first flexible drive means; a rotatable shaft having opposed ends mounting the driven member for rotation at one of the ends of the shaft, the shaft being mounted in at least one bearing means mounted on the frame; a rotatable drive member mounted at the other of the ends of the shaft; a second flexible drive means mounted on the rotatable drive member which when activated rotates the shaft and driven member; and an electric drive motor member mounted adjacent to the other of the ends of the frame with a rotatable means which is connected to the second flexible drive means, wherein when the drive motor is activated the rotatable means moves the second flexible drive means, rotates the drive member, shaft and driven member to move the first flexible drive means and the carriage assembly to open and close the door.

Further, the present invention relates to a building with a door operating apparatus for a reversibly operable door, which comprises: a frame with opposed ends to be mounted and extend away from the door inside the building; a carriage assembly mounted on the frame at one of the ends so as to be adjacent to and connected to the door and linearly moveable on the frame for moving the door between open and closed positions; a first flexible drive means connected to the carriage assembly and which extends adjacent the frame away from the one of the ends of the frame and which when activated moves the carriage to open and close the door; a rotatable driven member mounted on the frame, which driven member mounts and drives the first flexible drive means; a rotatable shaft having opposed ends mounting the driven member for rotation at one of the ends of the shaft, the shaft being mounted in at least one bearing means mounted on the frame; a rotatable drive member mounted at the other of the ends of the shaft; a second flexible drive means mounted on the rotatable drive member which when activated rotates the shaft and driven member; and an electric drive motor member mounted on the other of the ends of the frame with a rotatable means which is connected to the second flexible drive means, wherein when the drive motor is activated the rotatable means moves the second flexible drive means, rotates the drive member, shaft and driven member to move the first flexible drive means and the carriage assembly to open and close the door.

Finally, the present invention relates to a method of installing a door operating apparatus for a reversibly operable door in a building with a relatively short space between the door and a beam in the building, which comprises: a frame with opposed ends to be mounted away from the door inside the building; a carriage assembly mounted on the frame at one of the ends so as to be adjacent to and connected to the door and linearly moveable on the frame for moving the door between open and closed positions; a first flexible drive means connected to the carriage assembly and which extends adjacent the frame away from the one of the ends of the frame and which when activated moves the carriage to open and close the door; a rotatable driven member mounted on the frame, which driven member mounts and drives the first flexible drive means; a rotatable shaft having opposed ends mounting the driven member for rotation at one of the ends of the shaft, the shaft being mounted in at least one bearing means mounted on the frame; a rotatable drive member mounted at the other of the ends of the shaft; a second flexible drive means mounted on the rotatable drive member which when activated rotates the shaft and driven member; an electric drive motor member mounted on the other of the ends of the frame with a rotatable means which is connected to the second flexible drive means, wherein when the drive motor is activated the rotatable means moves the second flexible drive means, rotates the drive member, shaft and driven member to move the first flexible drive means and the carriage assembly to open and close the door; and mounting the frame in the building adjacent to the door and on the beam of the building and connecting the carriage assembly to the door, wherein the electric motor is mounted adjacent to the beam.

In most instances, the drive and driven members are bicycle type sprockets mounted on the drive shaft and bicycle type chains which are provided to engage the sprockets. This power transfer mechanism provides the safest and most reliable door opening apparatus.

Thus, the invention relates to an electrically operated door opener, preferably with a chain drive mechanism. Usually, it is fitted into a garage. Attached to the electrically operated garage door opener is a length of a first bicycle type chain geared to the internal chain drive mechanism of the garage door opener motor. The other end of this length of bicycle type chain, as a first chain, is mounted around a drive sprocket mounted on a shaft. The shaft is preferably a length of round steel bar with the drive sprocket and a driven sprocket mounted on each of the ends. The shaft is of a length to fit the installation space parameters vertically, and is mounted perpendicular to the first chain. The shaft is mounted rearward of the garage door opener and garage door.

A length of a similar bicycle type chain, as a second chain, is fitted to the driven sprocket at the other end of said shaft. Movement and travel of the second chain is guided by a traverse rail, forwardly directed and ceiling located, towards the top of the garage door. Extending from the end of this said chain is a length of cable which is attached to the top of the garage door through a hinged bracket in a carriage assembly.

The electrically operated door opener mechanism is mounted on the ceiling area of the garage, or from a side wall on beams or installed on mounts at a height equal to the height of the garage door in its raised position. The entire mechanism is essentially parallel to the garage floor in its fully installed position.

Preferably, mounted interiorly on the garage door frame, on both sides of the garage door opening, at no higher than six (6) inches, are infrared light optical sensors for an auto-reverse safety system. The infrared optical sensor projects a beam across the garage door opening that detects people or objects which are in the way of the closing door.

The garage door opener is activated by a handheld remote controller or can be activated by wall mounted activation switch, interiorly or exteriorly located in the building. The door opener is particularly adapted for garage doors presently installed in older homes and new homes, which do not have sufficient clearance to install a conventional electrically operated garage door having Federally mandated safety features. The improved electrically actuated overhead garage door opener assembly, provides for electric garage doors to be installed in a garage area which has limited overhead space, or which have a wall mounted garage door opener which is operated by cables and which is unsafe.

The improved apparatus is particularly adapted for homes that have an electrically operated garage door opener which was installed before Federal laws mandated motion sensors or other safety mechanisms which prevent the downward closing movement of a garage door when someone or something passes across the closing door's path. The safety feature is mandated by law to prevent accidental injuries caused by a door that has no means of stopping once the closing mechanism is activated. This safety feature has been included in this invention to bring older garage door openers in line with Federal safety laws.

When the electrically operated garage door opener mechanism is activated by either a remote controller or an activation switch, the garage door motor initiates the first chain drive on the drive sprocket on the rearward perpendicular shaft which rotates said shaft which rotates the driven sprocket which moves the second chain and cable combination. The rearward movement of the second chain and cable attached to the top of the garage door carriage assembly pulls the garage door upward along its track in a rearward motion, opening the garage door.

When the garage door is in its upward and rearward position, the garage door is open. The garage door is closed by the activation of the electrically operated garage door opener by remote controller or interior or exterior wall mounted activation switch causing a reverse movement of the chain drive mechanism in the garage door opener. The first chain linkage to the drive sprocket reverses direction, thereby moving the shaft and driven sprocket in a reverse direction, rotating the second chain and cable to the carriage assembly mounted on the top of the garage door, allowing the door to move in a forward direction by the release of tension in the conventional garage door torsion or ballast system, thus closing the garage door.

Objects

It is therefore an object of the present invention to provide a reversible door opener apparatus which enables the mounting in a building where the space is confined. Further still, it is an object of the present invention to provide an opener which is safe and which does not rely on mechanisms which power cables on the sides of the door.

These and other objects will become increasingly apparent by reference to the following description and the drawings.

DESCRIPTION OF PREFERRED EMBODIMENTS

Figure 1:
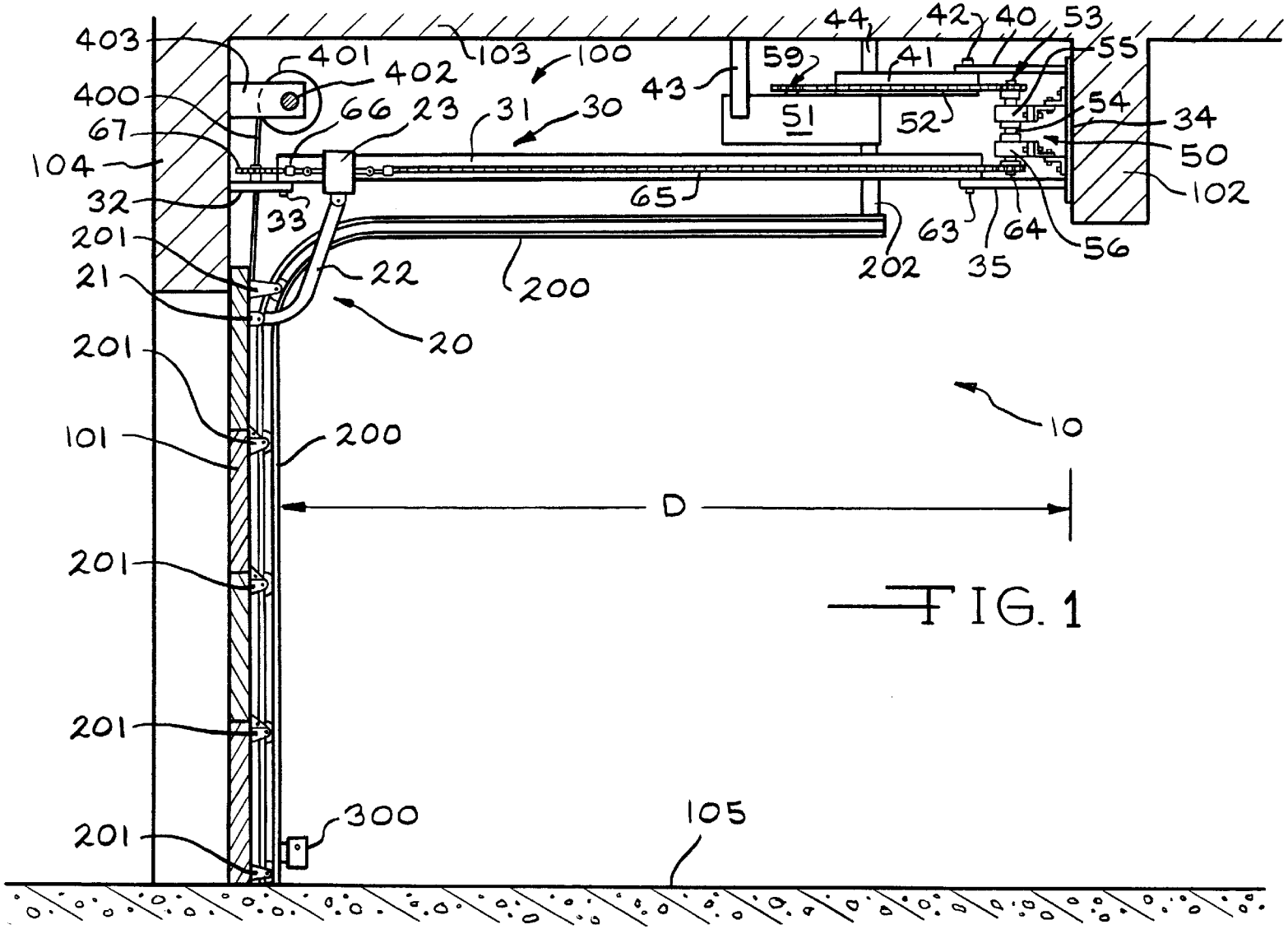
FIG. 1 is a front view of the apparatus 10 of the present invention installed in a building 100 for opening and closing a door 101 which is shown as closed.

FIGS. 1 to 7 show the apparatus 10 of the present invention installed in a building 100 with a floor 105. The building 100 includes a beam 102 or other obstacle, a ceiling 103 comprised of rafters (not shown) and a front frame 104 below the ceiling 103 which surrounds the door 101. The door 101 rides on two (2) angled guides 200 and on rollers 201 mounted on the door 101. The guides 200 are preferably mounted on the frame 104 of the building 100 and on the ceiling 103 on adjacent sides of the door 101 in a conventional manner. Brackets 202 (one shown) secure the guide 200 to the ceiling 103. As can be seen from FIG. 1, the distance D between the door 101 and the beam 102 is short and thus, prevents the installation of a standard door opener apparatus. In order to solve this problem, a transfer mechanism 50 was provided as discussed in detail hereinafter.

Figure 3:
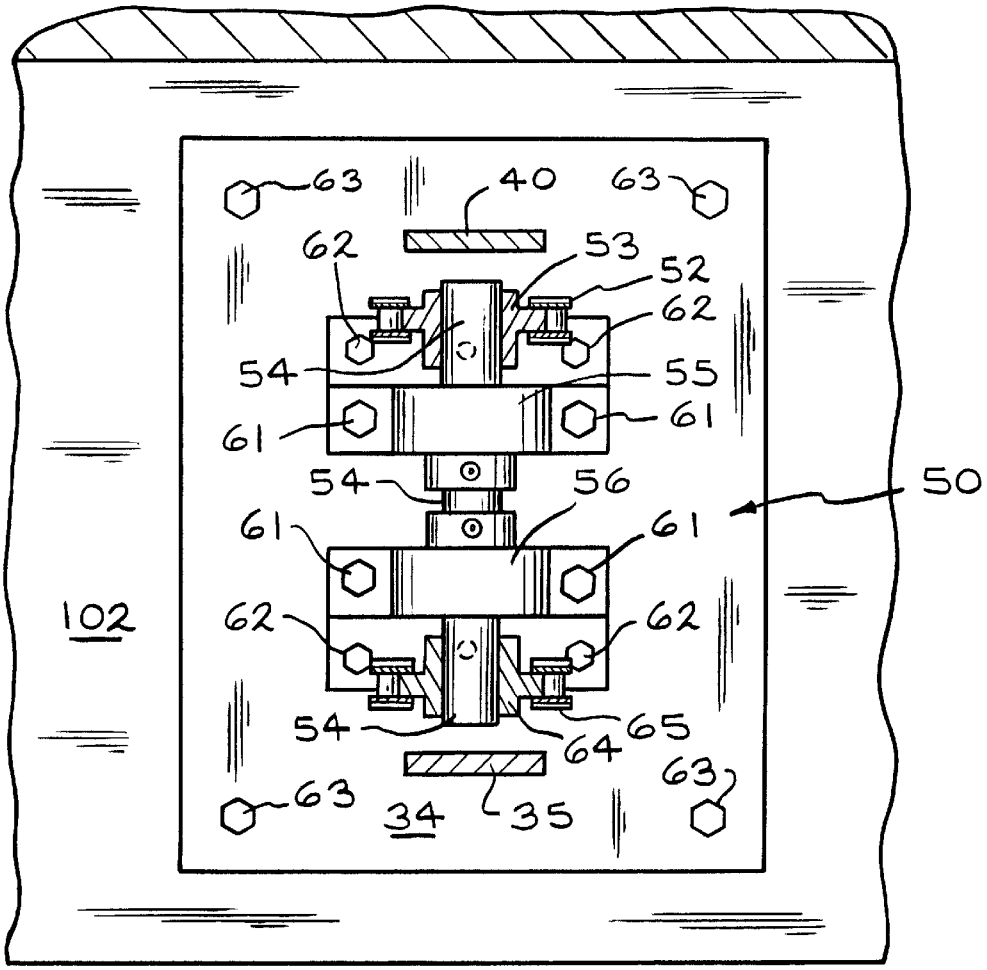
FIG. 3 is an end cross-sectional view along line 3—3 of FIG. 1 showing the transfer mechanism 50.

The apparatus 10 includes a carriage assembly 20 pivotally attached to door 101. The assembly 20 includes a bracket 21 pivotally connected to arm 22 connected to carrier 23, slidably mounted on track or rail 31 which forms part of the frame 30. The track 31 is supported by extension 32 on frame 104 of the building 100 above the door 101. Typically the extension 32 is secured to the track or rail 31 by a fastener 23. The track 31 extends towards the beam 102 and is supported by a plate 34, which is vertically oriented to which is attached another extension 35. The plate 34 can be attached to beam 102 by bolts 63 (FIG. 3). Upper extension 40 is secured to plate 34 and supports a second track 41 by means of fastener 42 which is secured to drive unit or electrical motor 51. Securing members 43 and 44 are attached to the ceiling 103 and to opposite sides of the motor 51.

Figure 4:
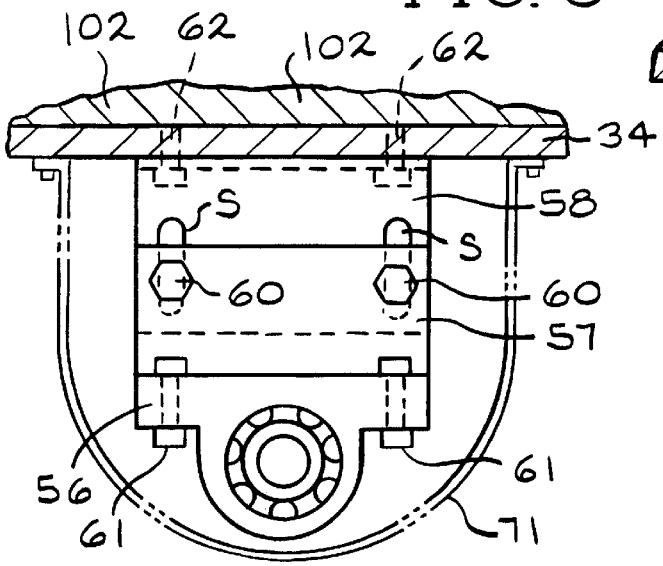
FIG. 4 is a plan cross-sectional view along line 4—4 of FIG. 3 showing a lower bearing assembly 56.
Figure 5:
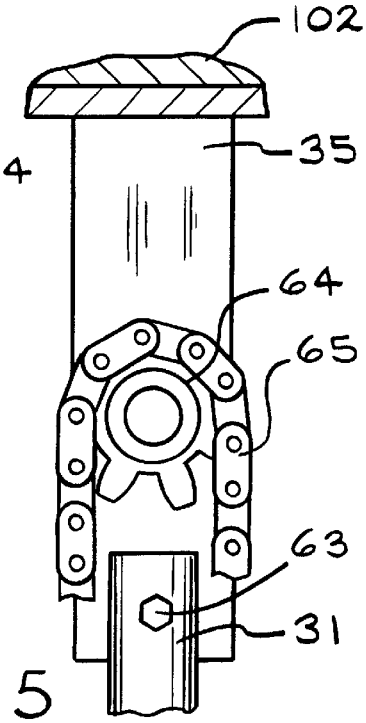
FIG. 5 is a cross-sectional view along line 5—5 of FIG. 3 showing a sprocket 64 and chain 65 assembly.
Figure 6:
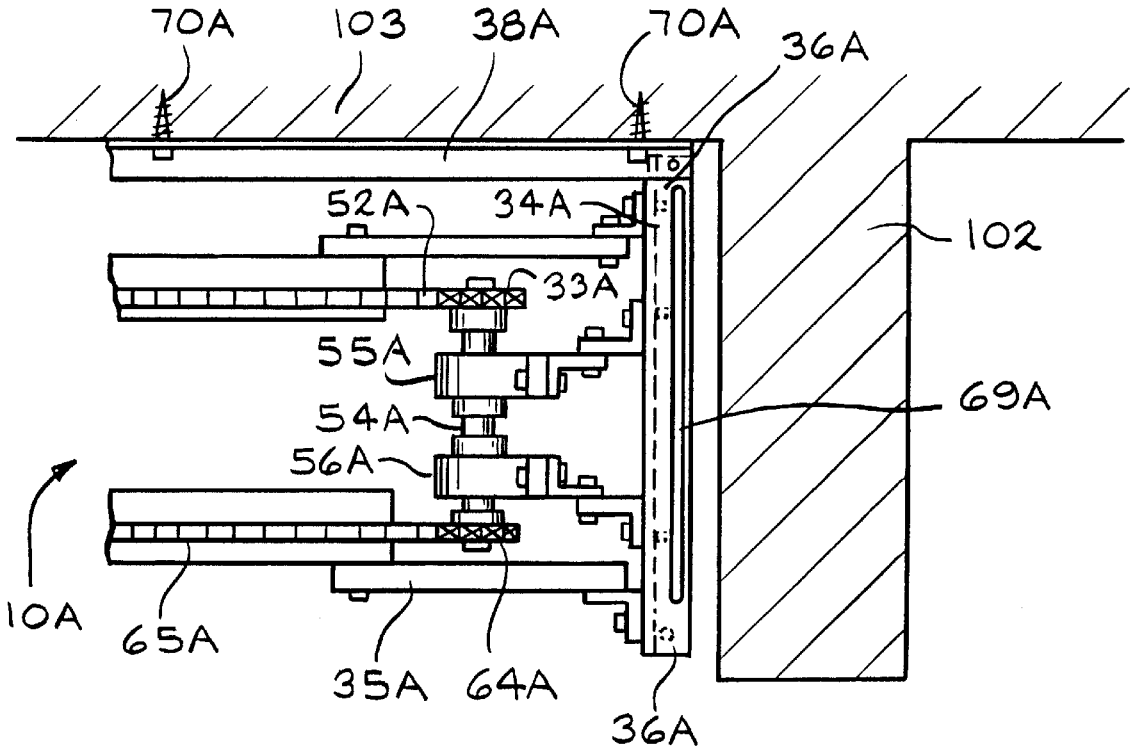
FIG. 6 is a front view in partial section of an alternate preferred version of the apparatus 10A which mounts on the ceiling 103 of the building 100.

The drive unit 51 powers the transfer mechanism 50 of the present invention with a motor sprocket 59 driven by motor 51. A chain 52 is mounted on the motor sprocket 59 and on a drive sprocket 53 mounted on a shaft 54 mounted on bearing assemblies 55 and 56, which are secured to plate 34 by adjustable plates 57 and 58 (FIG. 4). As shown in detail in FIG. 4, the bearing assemblies 55 and 56 are secured by bolts 61 to plate 57 which overlaps plate 58. Plates 58 have slots S and are held together by bolts 60. The plate 58 is secured to plate 34 by means of bolts 62. As shown in FIG. 3, the plate 34 can be mounted on the beam 102 by bolts 63. FIG. 6 shows an alternate mounting.

A driven sprocket 64 (see FIG. 5) is mounted on shaft 54 and is in line horizontally with track 31. A chain with a cable 65 is mounted on the sprocket 64. The chain 65 is mounted on a sprocket 67 adjacent the door 101 attached to a chain 65 around the driven sprocket 64 and then attached to the carrier 23 of the carriage assembly 20 by tensioning member 66 in a conventional manner. The plates 57 and tensioning member 66 on carrier 23 are adjusted so that the chains 52 and 65 are taut. The track 31 is secured by bolt 63 to the lower extension 35.

Figure 2:
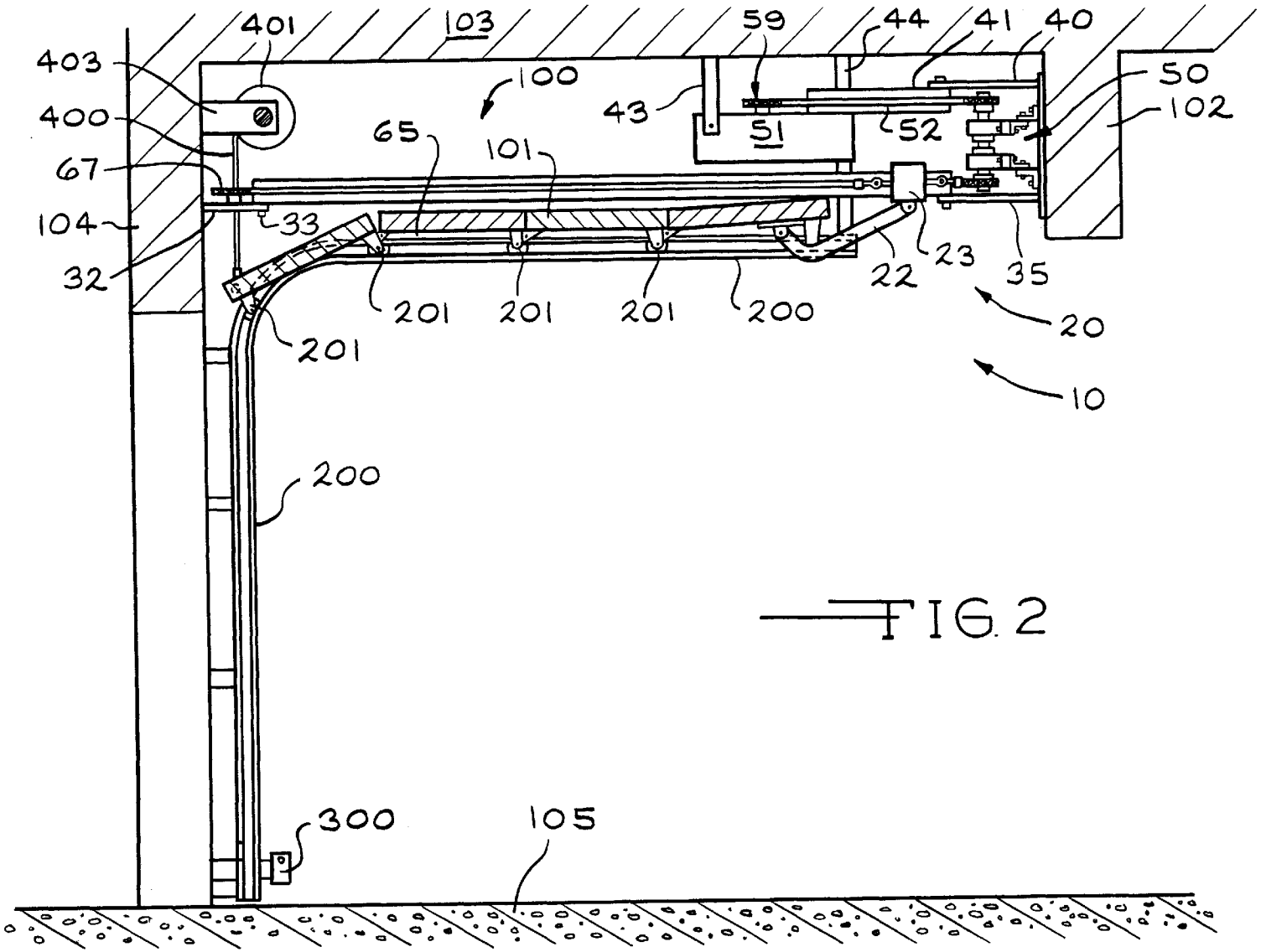
FIG. 2 is a front view of the apparatus 10 of FIG. 1 with the door 101 open.

In operation, a remote control (not shown) is activated to operate the motor 51 to open and close the door 101. The motor sprocket 59 drives chain 52 and drive sprocket 53. Shaft 54 turns driven sprocket 64 and moves the carriage assembly 20 to open the door 201 as shown in FIG. 2. In reverse, the door 101 is closed in the same manner as shown in FIG. 1. The result is a very reliable door 101 opening and closing system which is safe.

An electronic sensor 300 can be used to prevent the door 101 from closing in the event there is an obstruction in the path of the door 101, as a conventional safety measure. As usual, various anti-racking means can be used on the opposed sides of the door 101 such as wires 400 on pulleys 401 on shafts 402 supported on bracket 403 which can be spring 404 (FIG. 7) loaded to tend to counterbalance the weight of the door 201. Although this is well known to those skilled in the art.

Figure 7:
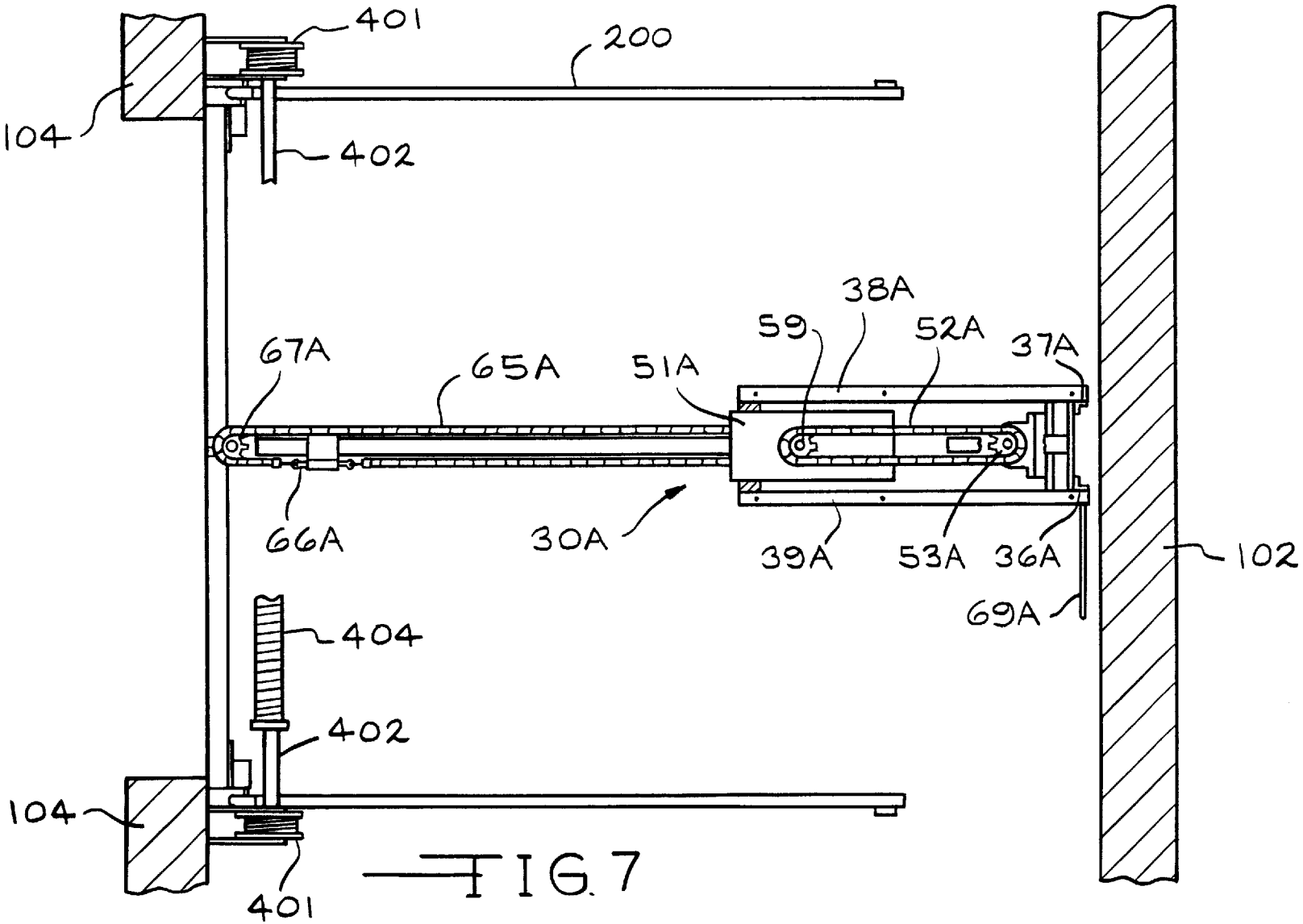
FIG. 7 is a plan view of the apparatus 10A showing details of the frame 30A.

FIGS. 6 and 7 show an alternate preferred embodiment of the present invention which mounts on the ceiling 103 rather than on the beam 102. The like numbers are marked with an "A" to FIGS. 1 to 5. Angle irons 36A, 37A, 38A and 39A are provided on the frame 30A. Brace 69A connects to angle irons 38A and 39A which form right (90°) angles with braces 36A and 37A. Threaded members 70A mount on a rafter (not shown) in the ceiling 103. The operation of the alternate embodiment of FIGS. 6 and 7 is the same as in FIGS. 1 to 5.

The sprockets 51, 51A, 53, 53A, 64, 64A and 67 and 67A can have various diameters and tooth configurations. Those which are preferred are shown in Table 1.

TABLE 1

| Sprocket | Diameter | Number of Teeth |
|---|---|---|
| 51, 51A | 1.5" | 8 |
| 53, 53A | 1.5" | 8 |
| 64, 64A | 1.5" | 8 |
| 67, 67A | 1.5" | 8 |

The diameters of the sprockets is standard in garage door openers. Usually, the lower sprocket 64 or 64A is adjustable on the shaft 54 or 54A by means of screws through a hub of the sprocket (not shown).

It will be appreciated that if desired, the speed of rotation of the drive or driven sprockets can be reduced or speeded up by using sprockets of different diameters. Obvious variations will occur to more skilled in the art.

As shown in FIGS. 1 to 5, the length of the rail or track 31 is set to be slightly less than the dimension D. As will be appreciated, the rail or track 31 can be made to telescope to enable the plate 34 to engage the beam 102. A longer or shorter chain would be used. All of these variations will be obvious to one skilled in the art.

It is intended that the foregoing description be only illustrative of the present invention and that the present invention is only limited by the hereinafter appended claims.

I claim:

1. A door operating apparatus for a reversibly operable door in a building, which comprises:

(a) a frame with opposed ends to be mounted and extend away from the door inside the building wherein the frame has an upper leg and a lower leg below the upper leg with a transfer mechanism mounted between both legs;

(b) a carriage assembly mounted on the lower leg of the frame at one of the ends so as to be adjacent to and connected to the door and linearly moveable on the frame for driving the door between the open and closed positions;

(c) a first flexible driving means connected to the carriage assembly and which extends adjacent the lower leg of the frame away from the one of the ends of the frame and which when activated moves the carriage to open and close the door;

(d) a rotatable driven member, wherein the transfer members includes the rotatable driven member, which driven member mounts and drives the first flexible driving means;

(e) a rotatable shaft having opposed ends mounting the driven member for rotation at one of the ends of the shaft, the shaft being mounted in at least one bearing as part of the transfer mechanism;

(f) a rotatable drive member mounted at the other of the ends of the shaft as part of the transfer mechanism;

(g) a second flexible driving means mounted on the rotatable drive member which when activated rotates the shaft and drives the driven member; and (h) an electric drive motor member mounted on the upper leg adjacent to the other of the ends of the frame with a rotating means which is directly connected to the second flexible driving means, wherein when the drive motor is activated the rotating means moves the second flexible driving means, rotates the drive member, shaft and driven member to move the first flexible driving means and the carriage assembly to open and close the door.

2. The apparatus of claim 1 wherein the drive and driven members are both sprockets and wherein the first and second flexible driving means comprise chains which engage the sprockets.

3. The apparatus of claim 1 or 2 wherein the legs are horizontal when mounted on the building.

4. The apparatus of claim 1 wherein the upper leg of the frame is above the drive motor member with the second flexible driving means between the drive member and the rotating means of the motor.

5. The apparatus of claim 1 wherein, the rotating means of the motor is a motor sprocket which mounts a chain which rotates the drive member which is a sprocket.

6. The apparatus of claim 1 wherein the bearing mounts the shaft so as to rotate on a vertical axis when installed in the building with the first and second flexible driving means oriented in spaced apart horizontal planes.

7. The apparatus of claim 1 wherein the first and second flexible driving means are essentially parallel to each other.

8. The apparatus of claim 1 wherein the shaft is adjustable relative to the plate to tension the front and second flexible driving means.

9. A building with a door operating apparatus for a reversibly operable door, which comprises:

(a) a frame with opposed ends to be mounted and extend away from the door inside the building wherein the frame has an upper leg and a lower leg below the upper leg with a transfer mechanism connected between both legs;

(b) a carriage assembly mounted on the lower leg of the frame at one of the ends so as to be adjacent to and connected to the door and linearly moveable on the frame for driving the door between open and closed positions;

(c) a first flexible driving means connected to the carriage and which extends Adjacent the lower leg of the frame away from the one of the ends of the frame and which when activated moves the carriage assembly to open and close the door;

(d) a rotatable driven member, wherein the transfer mechanism includes the rotatable driven member, which driven member mounts and drives the first flexible driving means;

(e) a rotatable shaft having opposed ends mounting the driven member for rotation at one of the ends of the shaft, the shaft being mounted in at least one bearing as part of the transfer mechanism;

(f) a rotatable driving member mounted at the other of the ends of the shaft as part of the transfer mechanism;

(g) a second flexible driving means mounted on the rotatable drive member which when activated rotates the shaft and drives the driven member; and (h) an electric drive motor member mounted on the upper leg on the other of the ends of the frame with a rotating means which is directly connected to the second flexible driving means, wherein when the drive motor is activated the rotating means moves the second flexible driving means, rotates the drive member, shaft and driven member to move the first flexible driving means and the carriage assembly to open and close the door.

10. The building of claim 9 wherein the drive and driven members are both sprockets and wherein the first and second flexible driving means comprise chains which engage the sprockets.

11. The building of claim 9 wherein the legs are horizontal as mounted in the building.

12. The building of claim 9 wherein the shaft is adjustable relative to the plate to tension the first and second flexible driving means.

13. The building of claim 9 wherein the upper leg of the frame is above the drive member with the second flexible driving member between the drive member and the rotating means of the motor.

14. The building of claim 9 wherein the rotating means of the motor mounts a motor sprocket which mounts a chain which rotates the drive member which is a sprocket.

15. The building of claim 9 wherein the bearing mounts the shaft so as to rotate on a vertical axis in the building with the first and second flexible driving means oriented in spaced apart horizontal planes.

16. The building of claim 9 Wherein the first and second flexible driving means are essentially parallel to each other.

17. A method of installing a door operating apparatus for a reversibly operable door in a building with a relatively short space between the door and a beam in the building, which comprises:

(a) a frame with opposed ends to be mounted extend away from the door inside the building wherein the frame has an upper leg and a lower leg below the upper leg with a transfer mechanism mounted between both legs;

(b) a carriage assembly mounted on the lower leg of the frame at one of the ends so as to be adjacent to and connected to the door and linearly moveable on the frame for moving the door between open and closed positions;

(c) a first flexible driving means connected to the carriage and which extends adjacent the lower leg of the frame away from the one of the ends of the frame and which when activated drives the carriage assembly to open and close the door;

(d) a rotatable driven member, wherein the no transfer mechanism includes the rotatable driven member, which driven member mounts and drives the first flexible driving means;

(e) a rotatable shaft having opposed ends mounting the driven member for rotation at one of the ends of the shaft, the shaft being mounted in at least one bearing as part of the transfer mechanism;

(f) a rotatable drive member mounted at the other of the ends of the shaft as part of the transfer mechanism;

(g) a second flexible driving means mounted on the rotatable drive member which when activated rotates the shaft and drives the driven member;

(h) an electric drive motor member mounted on the upper leg of the other of the ends of the frame with a rotating means which is directly connected to the second flexible driving means, wherein when the drive motor is activated the rotating means moves the second flexible driving means, rotates the drive member, shaft and driven member to move the first flexible driving means and the carriage assembly to open and close the door; and (i) mounting the frame in the building adjacent to the door and on the beam of the building and connecting the carriage assembly to the door, wherein the electric motor is mounted adjacent to the beam.

18. The method of claim 17 wherein the drive and driven members are both sprockets and wherein the first and second flexible driving means are chains which engage the sprockets.

19. The method of claim 17 wherein the legs are horizontal in the building.

20. The method of claim 17 wherein the first and second flexible driving means are essentially parallel.

21. The method of claim 17 wherein the upper leg of the frame is above the drive member with the second flexible driving means between the driving member and the rotating means of the motor.

22. The method of claim 21 wherein the rotating means of the motor is a motor sprocket which mounts a chain which rotates the drive member which is a sprocket.

23. The method of claim 17 wherein the bearing on the frame mounts the shaft so as to rotate on a vertical axis as a result of the installing with the first and second flexible driving means oriented in spaced apart horizontal planes.

* * * * *